US005288254A

United States Patent [19]

Elson

[11] Patent Number: 5,288,254

[45] Date of Patent: Feb. 22, 1994

[54] SWIMMER'S HAND PADDLE

[76] Inventor: Timothy P. Elson, 1570 Charterwood Ct., Thousand Oaks, Calif. 91362

[21] Appl. No.: 922,553

[22] Filed: Jul. 29, 1992

[51] Int. Cl.[5] ..... A63B 31/00

[52] U.S. Cl. ..... 441/56; 441/58

[58] Field of Search ..... 441/55-59

[56] References Cited

U.S. PATENT DOCUMENTS

| | | | |
|---|---|---|---|
| 183,045 | 10/1876 | Dunlop | 441/58 |
| 1,971,844 | 8/1934 | Babbitt | 441/58 |
| 3,765,042 | 10/1973 | Montrella | 441/58 |
| 4,493,663 | 1/1985 | Richmond | 441/56 |
| 5,147,233 | 9/1992 | Hannula | 441/56 |

OTHER PUBLICATIONS

Advertising Order Form—Date and Origin Unknown.
Swimming World; Sep., 1991; p. 44.
Triathlete; Jun., 1992; pp. 89, 90 and 92.
Swimming World; May, 1992; pp. 32 and 33.
Swimming World; Nov., 1991; p. 53.

*Primary Examiner*—Jesus D. Sotelo
*Attorney, Agent, or Firm*—Joseph E. Gerber

[57] ABSTRACT

A swimmer's hand paddle comprised of a planar member having a perpendicularly depending fin is disclosed. The paddle's planar member is bilaterally symmetrical and generally triangular. It has a textured upper surface, a rounded forward apex, a pair of divergent opposing side edges and an inwardly-curved rearward edge. A rearward projection is defined on each side of the planar member between the outer end of the rearward edge and the rearward end of the adjacent side edge. The fin is generally triangular and depends from the planar member's lower surface. Its narrower end is disposed adjacent the planar member's forward apex and its wider end is disposed adjacent the planar member's rearward edge. Opposing ends of a length of resilient tubing pass through a pair of adjacent apertures in planar member, thereby forming a loop which projects above the plane of the upper surface and is adapted to receive and bind a swimmer's middle finger to the planar member.

25 Claims, 2 Drawing Sheets

SWIMMER'S HAND PADDLE

BACKGROUND OF THE INVENTION

1. Field Of The Invention

The present invention relates generally to swimmer's training aids, and more specifically to paddles for use on a swimmer's hands.

2. Description Of The Related Art

A competitive swimmer's performance can be improved in two basic ways, by perfecting technique and by building strength. Improvement of the arm portion of a swimming stroke, as separated from the kick portion of the stroke, has in the past been pursued with the use of devices fitted to the swimmer's hands. But, such devices tend to be much more effective at building arm strength than at promoting the perfection of technique. This drawback is well-recognized; thus, these hand devices are most commonly used in conjunction with pull buoys and other drag-increasing apparatus.

One genus of devices adapted to improving the arm portion of the stroke is commonly known as a "swim mit." Swim mits have been fashioned in several different designs, but all have some type of web between the fingers to create more resistance against the water than is available from a bare hand. It is undisputed that frequent use of swim mits helps build strength. However, their proper use requires the fingers of the hand to be splayed outward to expose the webs for maximum resistance against the water. This is unnatural. In the practice of proper swimming technique, the fingers are not to be splayed outward. Rather, they are to be held extended forward of the palm in a generally parallel orientation with little or no space between them. Thus, while using a swim mit may build strength, it encourages and reinforces improper hand and finger posture. Further, finger webbing tends to create distracting and inefficient hydraulic interference in the hand-entry part of the stroke as the hand first meets and cuts into the water. Therefore, swim mits have major drawbacks with respect to technique that may offset the benefits they offer for strength training.

Another genus of devices can be generally described as hand paddles. Quite a few different configurations of hand paddle are known, but all are planar and generally rectangular in shape. Various straps, lengths of resilient tubing and other such means are employed to bind these paddles to a swimmer's wrist, palm and/or fingers. Such hand paddles are, perhaps, better than swim mits for strength training because they present even more surface area to the water. However, they too present serious drawbacks to the development of proper arm and hand technique.

One drawback is that only the strongest and most experienced swimmers tend to benefit from hand paddle training. During the earliest part of the stroke when the hand is being driven downward just after entering the water, as in the freestyle, or crawl, stroke, conventional hand paddles put great stress on the shoulders. Above-average strength is therefore required to endure this stress without suffering immediate fatigue and risking injury. And, above-average strength is also required for the swimmer to avoid breaking form throughout the entire cycle of the stroke in response to the great resistance created by a hand paddle. The swimmer must, therefore, have well-established technique as well because, otherwise, hand paddle resistance will reinforce bad habits such as the failure to pull consistently throughout the entire stroke.

Another drawback is that all hand paddles have squared-off forward edges (i.e. blunt, straight and perpendicular to the direction of hand motion) which cause them to create a great amount of inefficient turbulence. They also tend to dive upon hand-entry, preventing the hand from following a proper planing motion in that part of the stroke. And, they are prone to wobble and pull away from the palm during the rearward portion of the stroke, even when a proper path is being followed.

Further, the power faces, or lower faces, of these conventional hand paddles, as opposed to the opposite, non-power face which is adapted to be bound to the swimmer's hand, are more or less planar. This permits a paddle so constructed to skid from side-to-side, or to wobble, upon hand-entry and immediately thereafter during the earliest power-generating part of the stroke. Even paddles having perforations therethrough, or textured lower surfaces, tend to be subject to the same problems.

Finally, conventional hand paddles inhibit a swimmer's achievement of proper body roll and elbow height. The preferred technique includes rotation of the hand just prior to its breaking the surface, so that the thumb side of the hand is lowest and the palm is turned upward at roughly a 45 degree angle, or so, from the water's surface. This rotation of the hand requires the elbow to be canted upward; if done properly it permits the hand to slice into the water's surface with minimal resistance. Upon breaking the surface and driving the hand forward the palm is rotated into a parallel relation with the surface and the planing action starts. Maximum reach is achieved by thrusting the shoulder forward as planing begins. This forward motion of the shoulder also causes the shoulder to dip downward which, when repeated sequentially, causes the body to roll from side to side. Unfortunately, conventional hand paddles disrupt this shoulder and elbow motion; they cause the training swimmer to throw the arm forward and to slap the surface with the paddle instead of slicing the hand in and planing.

Thus, although hand paddles may build strength, they cause the hand to follow an unnatural path of travel and thereby hurt technique.

Accordingly, it appears that a need exists for a device that permits a swimmer to train for strength in the arm portion of a stroke while teaching and reinforcing proper technique.

SUMMARY OF THE INVENTION

The swimmer's hand paddle of the present invention is adapted to overcome the above-noted shortcomings and to fulfill the stated needs. In the essence of one inventive subcombination, the hand paddle is generally planar and comprises: a rounded forward edge; first and second side edges; a rearward edge; and, means for retaining the hand paddle against the palm of a swimmer's hand.

In the essence of a second inventive subcombination, the hand paddle comprises: a generally triangular, planar member having an upper surface and a lower surface; and, means for retaining the planar member's upper surface against the palm of a swimmer's hand.

In the essence of yet a third inventive subcombination, the hand paddle comprises: a planar member having an upper surface and a lower surface, a forward end and a rearward end; opposing side edges; and, means adapted to receive and bind a swimmer's middle finger to the planar member.

In the essence of yet a fourth inventive subcombination, the hand paddle comprises: a planar member having an upper surface and a lower surface, a forward end and a rearward end; opposing side edges; a fin depending from the planar member's lower surface; and, means for retaining the planar member's upper surface against the palm of a swimmer's hand.

Further limitations include a pair of rearward projections flanking the wrist and the planar member being at least the approximate size of a swimmer's hand.

Thus, it is a general object of the present invention to provide a swimmer's hand paddle that permits one to train for strength and technique simultaneously.

And, it is a particular object of the present invention to provide a strength-training hand paddle that neither prevents, nor reinforces improper technique with respect to, the proper planing motion of the hand during the hand-entry part of the stroke.

It is more particularly an object of the present invention to provide a strength-training hand paddle able to teach a user the proper planing motion of the hand during the hand-entry part of the stroke.

Yet another particular object of this invention is to provide a hand paddle that minimizes side-to-side hand and arm motion during and just after the planing part of the stroke.

A further object of the invention is to provide a hand paddle shaped such that, primarily by water pressure, the paddle stays fast to the hand throughout the entire cycle of an arm stroke.

And, it is also an object of the invention to provide a hand paddle which minimizes stress to a swimmer's shoulders.

One feature of the invention that makes the above-identified objects of proper hand entry and planing possible is the rounded forward edge of the paddle. A further feature that contributes to these objects is its triangular shape. The triangular shape also serves the object of keeping the paddle fast to the hand throughout the stroke, while the middle finger of the hand being, alone, bound to the paddle serves as the merest attachment so that only balanced water pressure generated by proper technique keeps the paddle flush against the palm and fingers. And, the feature that discourages side-to-side hand and arm motion is the fin depending from the paddle's lower surface.

Features cooperate, as well. For example, the planar member's size and shape being approximately those of a swimmer's hand preserves technique, but the rearward projections add lift in the planing motion as well as added resistance against the water for strength-building throughout the stroke.

Some of the advantages to be gained from use of the inventive hand paddle herein include: a lengthened stroke with precisely directed hand entry; a nearly bubble-free entry which permits a clear view of one's hand position; reduced drag throughout the entire stroke cycle; and, a shortened learning time, for novices, of proper stroke technique. As the inventive hand paddle also has a streamlined shape, it causes the swimmer using it to look forward to assure that the paddle enters the water at the correct angle and planes properly. This "looking forward" rather than at the bottom of the pool is another component of correct technique that is enhanced, and thus is another advantage realized, through the use of this hand paddle. These advantages, along with a higher elbow position and an enhanced body roll, combine with the advantage of overall strengthening to meet long-felt, but unsolved needs in the field of swim training.

Other objects, features and advantages of the inventive hand paddle disclosed herein will be apparent from the drawings and following detailed description thereof.

DESCRIPTION OF THE PREFERRED EMBODIMENT

Figure 1:
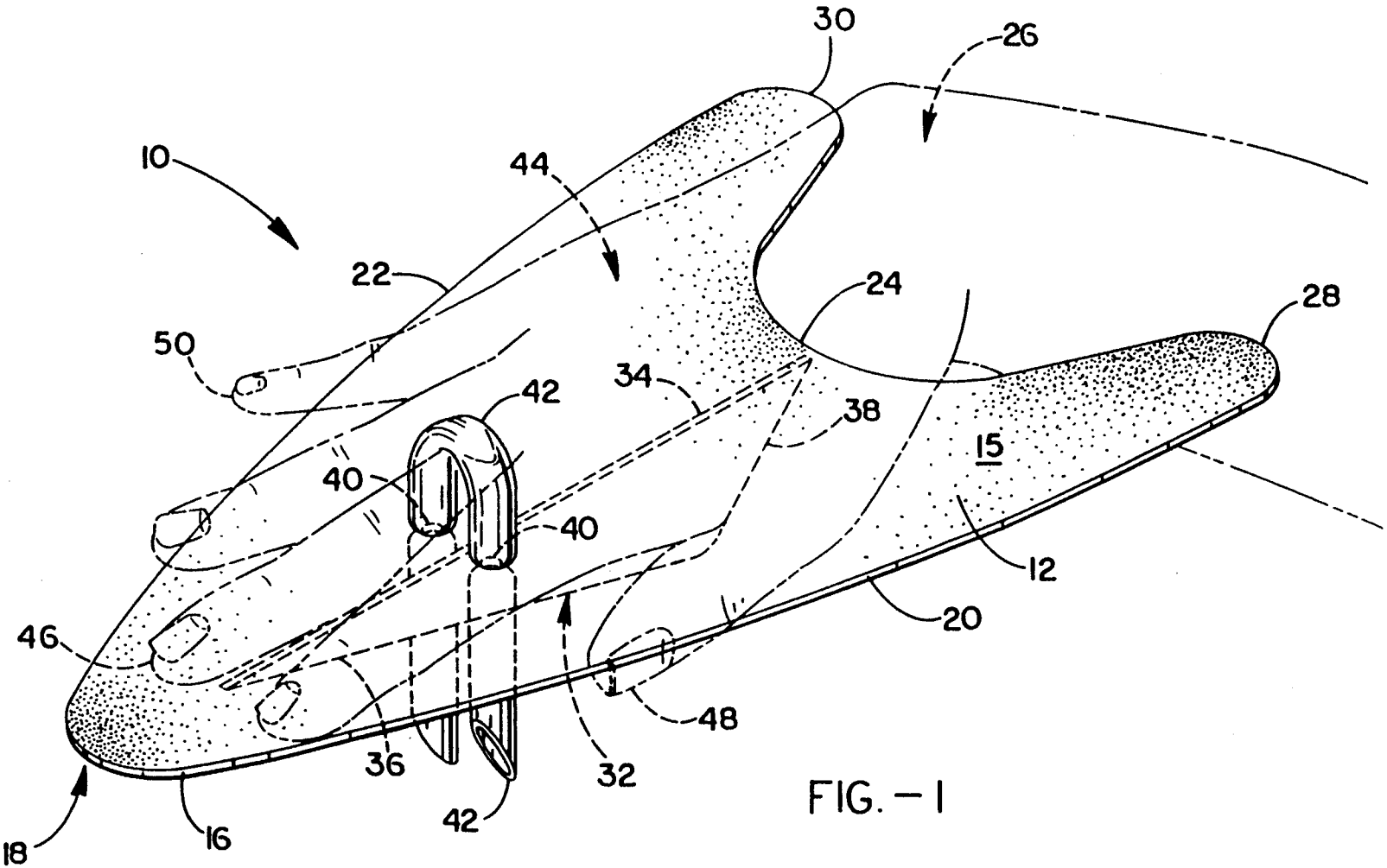
FIG. 1 is a perspective view of the hand paddle of the present invention in place for proper use on a swimmer's hand, the fin on the lower surface of the paddle being shown in broken line and the hand being shown in phantom line.
Figure 2:
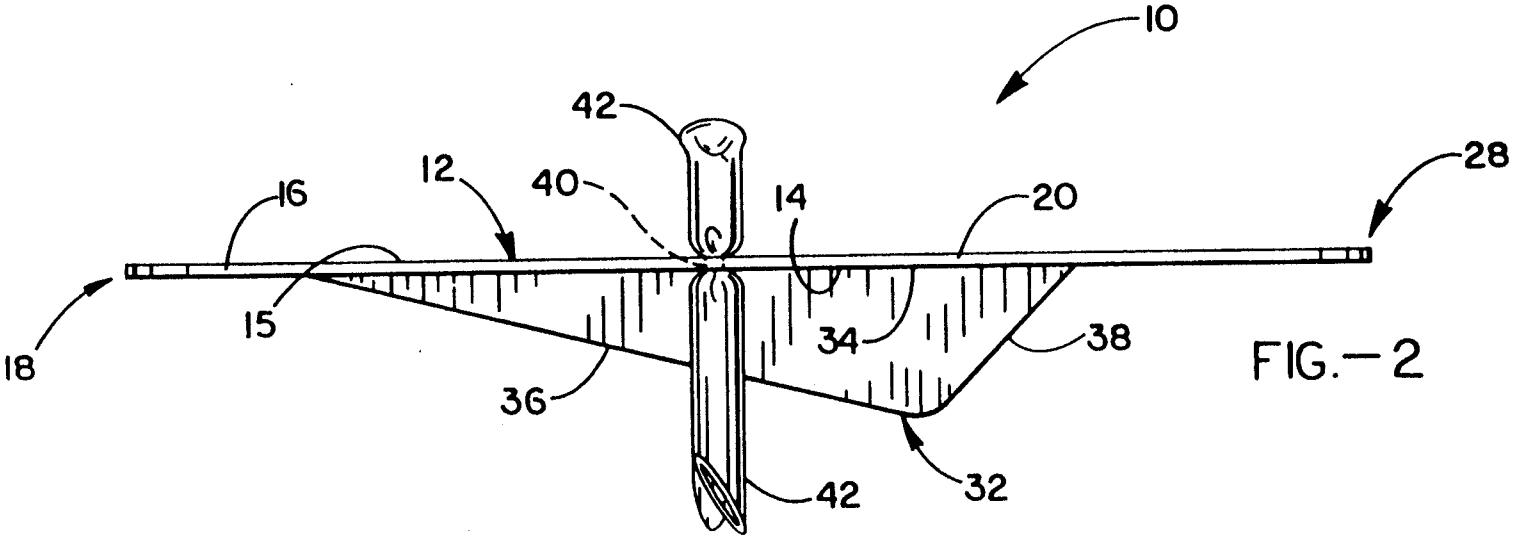
FIG. 2 is a left side elevation of the hand paddle illustrated in FIG. 1.
Figure 3:
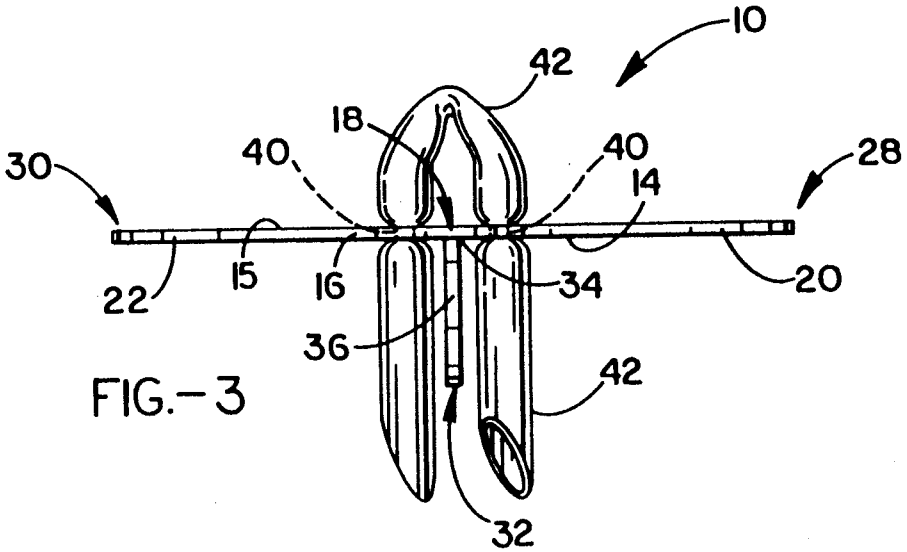
FIG. 3 is a front elevation of the hand paddle illustrated in FIG. 1.

Referring now specifically to the drawings, FIGS. 1, 2 and 3 show the preferred embodiment of the hand paddle of the present invention which is identified generally herein with reference numeral 10. The primary portion of hand paddle 10 is a planar member 12. Planar member 12 is constructed of durable rigid material, the preferred material being commonly known in the trade as "ABS plastic." However, other similarly rigid and durable materials may also suffice.

Planar member 12 has a lower surface 14 and an upper surface 15. Lower surface 14 is paddle 10's power face, and upper surface 15 is its non-power face.

Planar member 12 is bilaterally symmetrical and has the general shape of an isosceles triangle. The shape of planar member more specifically includes a rounded forward edge 16 defining apex 18; left and right side edges numbered 20 and 22, respectively; and, a rearward edge 24 opposite apex 18. As is preferred, forward edge 16 is convexly curved so as to be rounded; and, it is smoothly contiguous with side edges 20 and 22. Side edges 20 and 22 are rearwardly divergent and slightly outwardly-curved rather than being exactly straight.

Rearward edge 24 is inwardly-curved; one purpose of this feature being to accommodate a swimmer's flexed wrist 26 comfortably. Between the outer ends of rearward edge 24 and the rearward ends of side edges 20 and 22, a pair of projections 28 and 30, respectively, are defined. Projections 28 and 30 are rounded and project rearward a sufficient distance to flank a swimmer's wrist when the inventive paddle is in place for use as in FIG. 1. Projections 28 and 30 are not merely incidental features created as a byproduct of inwardly curving rearward edge 24. Instead, they are pronounced and prominent enough to provide hydraulic advantages such as enhanced lift during hand planing and increased resistance throughout the stroke.

The above-described shape is thought to work best for the purpose intended, although it is contemplated that satisfactory results may also be achieved if the planar member is more strictly triangular in shape, i.e. having a sharply angular apex and a straight rearward edge. Further, if right and left projections are appended to the rearward edge, these may be essentially triangular or rectangular in shape and still function reasonably well.

The preferred dimensions of planar member 12 include a width of approximately 6 inches between the outer edges of projections 28 and 30, and a length of approximately 11 inches between apex 18 and a point between the rearward-most extents of the projections. However, these dimensions may be altered as necessary, the guiding factor being that planar member 12 should be approximately the same size as the swimmer's hand. Nevertheless, it is also contemplated that larger, but swimmers, as well.

Beneath lower surface 14, a fin 32 projects perpendicularly. As with planar member 12, the preferred material for construction of fin 32 is ABS plastic. Fin 32 runs from a short distance behind apex 18, to rearward edge 24, bisecting planar member 12 where it meets same. Thus, fin 32 is oriented parallel to planar member 12's long axis. Fin 32 has the general shape of a scalene triangle, the longest side 34 of which meets, and is integral with, lower surface 14. Fin 32's longer free edge 36 is forward and its shorter free edge 38 is rearward; therefore, its narrower end is toward and adjacent to apex 18 and its wider end is toward and adjacent to rearward edge 24.

The finish of upper surface 15 of planar member 12 is textured as can be seen in FIG. 1, in contrast to lower surface 16 which is smooth, as are the surfaces of fin 32.

Planar member 12 has a pair of apertures 40 therethrough, which accommodate opposing ends of a short length of resilient tubing 42, leaving a loop thereof projecting above the plane of upper surface 15. Apertures 40 flank planar member 12's long axis and are slightly forward of the middle thereof. The diameters of apertures 40 are identical to each other and somewhat smaller than the diameter of tubing 42, so the tubing can be pulled to and from through the apertures with some resistance for secure adjustment of the size of the loop. The preferred resilient material for tubing length 42 is latex, although other similarly resilient and durable materials may also suffice.

In use, a swimmer places a hand 44, palm side down, on textured upper surface 15 and slips the middle finger 46 through the loop of tubing 42 to the point where it seats at the base of the finger. Neither the thumb 48, nor the pinky 50 should be splayed out unnecessarily beyond side edges 20 and 24. This causes forward edge 16 and apex 18 to be adjacent to the swimmer's fingertips and rearward edge 24 to be adjacent to the wrist 26. Thus, fin 32 is oriented in parallel relation to the axes of the fingers, the axes of which, in turn, should be generally parallel to one-another.

In practicing the arm portion of a swimming stroke, such as the freestyle, or crawl, for which the inventive hand paddle is best suited, the swimmer first extends the arm forward being careful to raise the elbow and to cant the hand so the thumb is downward. The hand and its attached paddle are driven as far forward as possible as they enter the water. Rounded forward edge 16 and panel member 12's triangular shape act separately, and cooperatively, to pierce the water's surface with minimal turbulence. While piercing the water's surface, the hand and paddle should rotate into a parallel relation to the surface and continue to be driven forward so that a planing motion is achieved. This planing motion should continue for some distance beyond the limited reach of a single arm stroke, this being possible, partly, due to the residual forward motion of the swimmer's entire body from previous strokes. Thrusting the shoulder forward also cooperates in lengthening the stroke. While this motion is being executed, planar member 12 should continue to be nearly parallel with the surface of the water to achieve optimum lift. Fin 32 cuts into the water and keeps the hand and arm from sliding or wobbling from side-to-side.

As the arm and hand, with the attached paddle, are driven downward through the stroke, fin 32 will cause the paddle to wobble unless the hand is being driven straight against the water and the pressure is even and perpendicularly directed toward both sides of the paddle's lower face 14, the "power face." Projections 28 and 30 aid in fine-tuning because, in addition to creating lift and aiding planing, they tend to tap against the swimmer's slightly cocked wrist if any wobble occurs. And, toward the end of the stroke's arc, if the swimmer is not driving the hand and paddle against the water in an upward direction until they fully meet the surface, the swimmer's forward motion will force water between them as they lag, peeling the paddle away from the hand. Thus, the roll, pitch and yaw of the paddle must be controlled throughout the entire stroke for the paddle to work smoothly. If turbulence or wobble are experienced, or the paddle tends to pull away from the hand, communication is sent by the paddle to the swimmer regarding the inefficiency of the stroke. Correction of the paddle's attitude to make it work most efficiently teaches the proper corresponding position for a swimmer's bare hand when not using the paddle.

The foregoing detailed disclosure of the inventive swimmer's hand paddle 10 is considered as only illustrative of the preferred embodiment of, and not a limitation upon the scope of, the invention. Those skilled in the art will envision many other possible variations of the structure disclosed herein that nevertheless fall within the scope of the following claims. For example, it is contemplated that the panel members of a pair of paddles may be shaped slightly differently for optimum efficiency of use, one being for the right hand and one being for the left. Or, a plurality of fins may be found to yield further advantages. Other means such as straps, clips or the like may also be used to bind one or more fingers, or other parts of the hand and/or wrist, to the paddle. These may be either flexible or essentially rigid. And, alternative uses for this inventive hand paddle may later be realized. Accordingly, the scope of the invention should be determined with reference to the appended claims, and not by the examples which have herein been given.

I claim:

1. A swimmer's hand paddle, comprising:

a. a planar member having an upper surface and a lower surface, a forward end and a rearward end, and opposing side edges;

b. a fin depending from said planar member's lower surface; and, c. means for retaining said planar member's upper surface against the palm of a swimmer's hand.

2. The hand paddle of claim 1, wherein said planar member's upper surface is textured.

3. The hand paddle of claim 1, wherein said planar member has a narrower forward end and a wider rearward end.

4. The hand paddle of claim 3, wherein said retaining means acts to retain said planar member against a swimmer's hand such that said narrower end resides adjacent the swimmer's fingertips and said wider end resides adjacent the swimmer's wrist.

5. The hand paddle of claim 1, wherein said retaining means comprises means adapted to receive a swimmer's middle finger.

6. The hand paddle of claim 1, wherein said planar member includes first and second rearward projections.

7. The hand paddle of claim 1, wherein said planar member has a bilaterally symmetrical shape.

8. The hand paddle of claim 1, wherein said planar member has a bilaterally symmetrical shape, and wherein said fin bisects said planar member where said fin meets said planar member.

9. The hand paddle of claim 1, wherein said fin is oriented in perpendicular relation to said lower surface.

10. The hand paddle of claim 1, wherein said fin is oriented in parallel relation to the axes of the fingers of said swimmer's hand when said paddle is in place for proper use.

11. The hand paddle of claim 1, wherein said fin is triangular.

12. The hand paddle of claim 1, wherein said fin is a scalene triangle.

13. The hand paddle of claim 1, wherein said fin is a scalene triangle, the longest edge of which meets said planar member.

14. The hand paddle of claim 1, wherein a narrower end of said triangular fin is disposed toward said planar member's forward end and wherein a wider end of said fin is disposed toward said planar member's rearward end.

15. A swimmer's hand paddle, comprising:

a. a generally triangular, planar member having upper and lower surfaces, said upper surface being textured, and further including a rounded forward apex, a pair of opposing side edges and an inwardly-curved rearward edge;

b. a generally triangular fin depending from said planar member's lower surface, said fin having a narrower end disposed toward said planar member's forward apex and a wider end disposed toward said planar member's rearward edge; and, c. means adapted to receive and bind a swimmer's middle finger to said planar member.

16. A swimmer's hand paddle, said paddle being generally planar and comprising:

a. a rounded forward edge;

b. first and second side edges;

c. a rearward edge;

d. means for retaining a face of said hand paddle against the palm of a swimmer's hand; and, e. a fin projecting from a face of said paddle which opposes said face adapted to be retained against said palm of said swimmer's hand.

17. The hand paddle of claim 16, wherein said fin is oriented in parallel relation to the axes of the fingers of said swimmer's hand when said paddle is so retained.

18. A swimmer's hand paddle, comprising:

a. a generally triangular, planar member having an upper surface and a lower surface;

b. means for retaining said planar member's upper surface against the palm of a swimmer's hand; and, c. a fin projecting from said lower surface of said planar member.

19. The hand paddle of claim 18, wherein said fin is oriented in perpendicular relation to said lower surface.

20. The hand paddle of claim 18, wherein said fin is oriented in parallel relation to said planar member's long axis.

21. The hand paddle of claim 18, wherein said fin bisects said planar member where said fin meets said planar member.

22. The hand paddle of claim 18, wherein said fin is triangular.

23. The hand paddle of claim 18, wherein said fin is a scalene triangle.

24. The hand paddle of claim 18, wherein said fin is a scalene triangle, the longest edge of which meets said planar member.

25. A swimmer's hand paddle, comprising:

a. a planar member having an upper surface and a lower surface, a forward end and a rearward end, and opposing side edges;

b. means adapted to receive and bind only a swimmer's middle finger to said planar member; and, c. a fin projecting from said lower surface of said planar member.

* * * * *